US006332630B1

(12) United States Patent
Wolff et al.

(10) Patent No.: US 6,332,630 B1
(45) Date of Patent: Dec. 25, 2001

(54) BOUND FOLDER

(75) Inventors: Scott S. Wolff; Marcia E. Lausen, both of Evanston; Stephan Peter James Pfanner; Meeyoung C. Melamed, both of Chicago, all of IL (US)

(73) Assignee: ACCO Brands, Inc., Lincolnshire, IL (US)

( * ) Notice: Subject to any disclaimer, the term of this patent is extended or adjusted under 35 U.S.C. 154(b) by 0 days.

(21) Appl. No.: 09/346,688

(22) Filed: Jul. 2, 1999

(51) Int. Cl.[7] ..... B42D 3/00

(52) U.S. Cl. ..... 281/29; 402/73; 281/21.1; 281/15.1; 281/27.3; 412/1

(58) Field of Search ..... 281/15.1, 21.1, 281/29, 36, 37, 46, 27.3; 412/1, 4, 6, 36, 37, 43, 900, 901

(56) References Cited

U.S. PATENT DOCUMENTS

| | | | |
|---|---|---|---|
| 872,547 | 12/1907 | Uffner . | |
| 887,448 | 5/1908 | Wilinger . | |
| 3,212,505 | 10/1965 | Toman | 129/19 |
| 3,347,565 | 10/1967 | Konkel | 281/21 |
| 4,548,426 | 10/1985 | Lockhart | 281/29 |
| 4,697,970 | 10/1987 | Hanson | 412/4 |
| 4,793,758 | 12/1988 | Hanson et al. | 412/4 |
| 4,928,995 | 5/1990 | Pickering et al. | 281/29 |
| 4,964,656 | 10/1990 | Prentice | 281/44 |
| 5,052,872 | 10/1991 | Hunder et al. | 412/6 |
| 5,120,176 | 6/1992 | Bhatia et al. | 412/8 |
| 5,156,419 | 10/1992 | Minch | 281/21.1 |
| 5,192,093 | 3/1993 | Zeisky | 281/5 |
| 5,407,230 | 4/1995 | Brink et al. | 281/15.1 |
| 5,575,505 | 11/1996 | Bridges | 281/36 |
| 5,601,312 | 2/1997 | Funkhouser | 281/21.1 |
| 5,683,111 | 11/1997 | Bass et al. | 281/21.1 |
| 5,727,816 | 3/1998 | Ong | 281/29 |
| 6,010,157 * | 1/2000 | Pierson et al. | 281/29 |

FOREIGN PATENT DOCUMENTS

| | | |
|---|---|---|
| 0 110 237 A1 | 6/1984 | (EP) . |
| 0 246 850 A2 | 11/1987 | (EP) . |
| 1 382 574 | 11/1964 | (FR) . |

* cited by examiner

*Primary Examiner*—Willmon Fridie, Jr.
(74) *Attorney, Agent, or Firm*—Pennie & Edmonds LLP

(57) ABSTRACT

The present invention is directed to a sheet holder comprising a spine having at least first, second, third, and fourth panels attached in series by first, second, and third hinges, respectively. The panels and hinges are configured and associated such that the spine has a folded position in which the first and second panels are opposed to each other and define a stack space therebetween dimensioned to receive a stack. In this folded position, the third panel is folded over the second panel, and the fourth panel is folded over the first panel. The panels are associated such that a binding fastener is positionable through the first panel, the stack in the stack space, and the second panel. The fastener portions of the binding fastener are disposed between the second and third panels and between the first and fourth panels such that the third and fourth panels cover the fastener portions. A spine closure fastener associated with the first and fourth covers in the folded position to cover the fastener from view. The present invention is also directed to a method of holding at least one sheet within the sheet holder. A stack of sheets is insertable between the first panel and the second panel, forming an inner spine portion. Mechanical fasteners are driving through the inner spine portion to secure the stack of sheets. Once the stack of sheets is secured within the sheet holder with the mechanical fastener, the third and fourth panel are folded over the stack of sheets atop the second panel to abut the first panel. The fourth panel is secured to the first panel to cover the fastener from view.

21 Claims, 4 Drawing Sheets

BOUND FOLDER

FIELD OF THE INVENTION

This invention relates generally to sheet holders, and more particularly to folder for binding loose-leaf sheets.

BACKGROUND OF THE INVENTION

Documents are commonly prepared and secured for distribution and later retrieval for use by others. It is often desirable to bind these documents in a condition that facilitates review of the contents contained therein. It is known to punch a staple through the sheets of the document together with a stapler. Although such a mechanism is easy and inexpensive to use, the bound pages may rip from use, the folded ends of the staples are unsightly and often scratch items that come in contact with them and the pages are not protected against external elements. In addition, unless the document consists a fair number of pages, the document may be flimsy to be easily handled. Moreover, the overall appearance of the stapled documents does not compare to professionally bound documents.

U.S. Pat. No. 5,683,111 reference is directed to a binder system to conceal edges of pages held therein. The binder system has a cover with front and back segments and a fold segment that has at least a pair of spaced scorelines defining at least one fold subsegment. A pair of adhesive strips is attached alongside the fold subsegments and is covered by adhesive strip covers. The sheets of a document are first stapled to each other, and then the stack is inserted between the covers with the stapled edge proximate to the fold segment, and secured therein by the adhesive strips. This binder system conceals the edges of the ages and prevents exposure of the folded ends of the staple. As the binder system is secured only to the outer sheets of the stack, the stack is held within the binder by the strength of the adhesive material, which may become weakened with use.

U.S. Pat. No. 5,727,816 discloses a stapled report cover having a plurality of panels. The panels are folded over a plurality of pages that form a stack with bottom and top sheets. A binding margin on the stack is adjacent to a binding edge of the stack. A broad top cover panel extends to the binding margin, and a concealment panel is attached to the cover panel and extends across the narrow binding margin. The concealment panel is joined to a broad back panel a spine fold. The stack is fastened with a fastener at the narrow binding margin, and a layer of adhesive is located between the document cover and the binding margin of the stack to conceal the fastener where it protrudes from the top sheet of the stack.

Further, U.S. Pat. No. 4,548,426 discloses a method of making a report cover which allows a stack of paper held therein to lie flat. The Lockhart method includes a report cover that uses two panels, one of which includes three parallel hinges. One of the hinges on the panel remains pivotable to prevent pages of the report from "flying" back or the report from closing on its own when the cover is in an opened configuration.

SUMMARY OF THE INVENTION

The present invention is directed to a sheet holder comprising a spine having at least first, second, third, and fourth panels attached in series by first, second, and third hinges, respectively. The panels and hinges are configured and associated such that the spine has a folded position in which the first and second panels are opposed to each other and define a stack space therebetween dimensioned to receive a stack. In this folded position, the third panel is folded over the second panel, and the fourth panel is folded over the first panel. The panels are associated such that a binding fastener is positionable through the first panel, the stack in the stack space, and the second panel. The fastener portions of the binding fastener are disposed between the second and third panels and between the first and fourth panels such that the third and fourth panels cover the fastener portions. A spine closure fastener associated with the first and fourth covers in the folded position to cover the fastener from view.

DESCRIPTION OF THE PREFERRED EMBODIMENT

Figure 1:
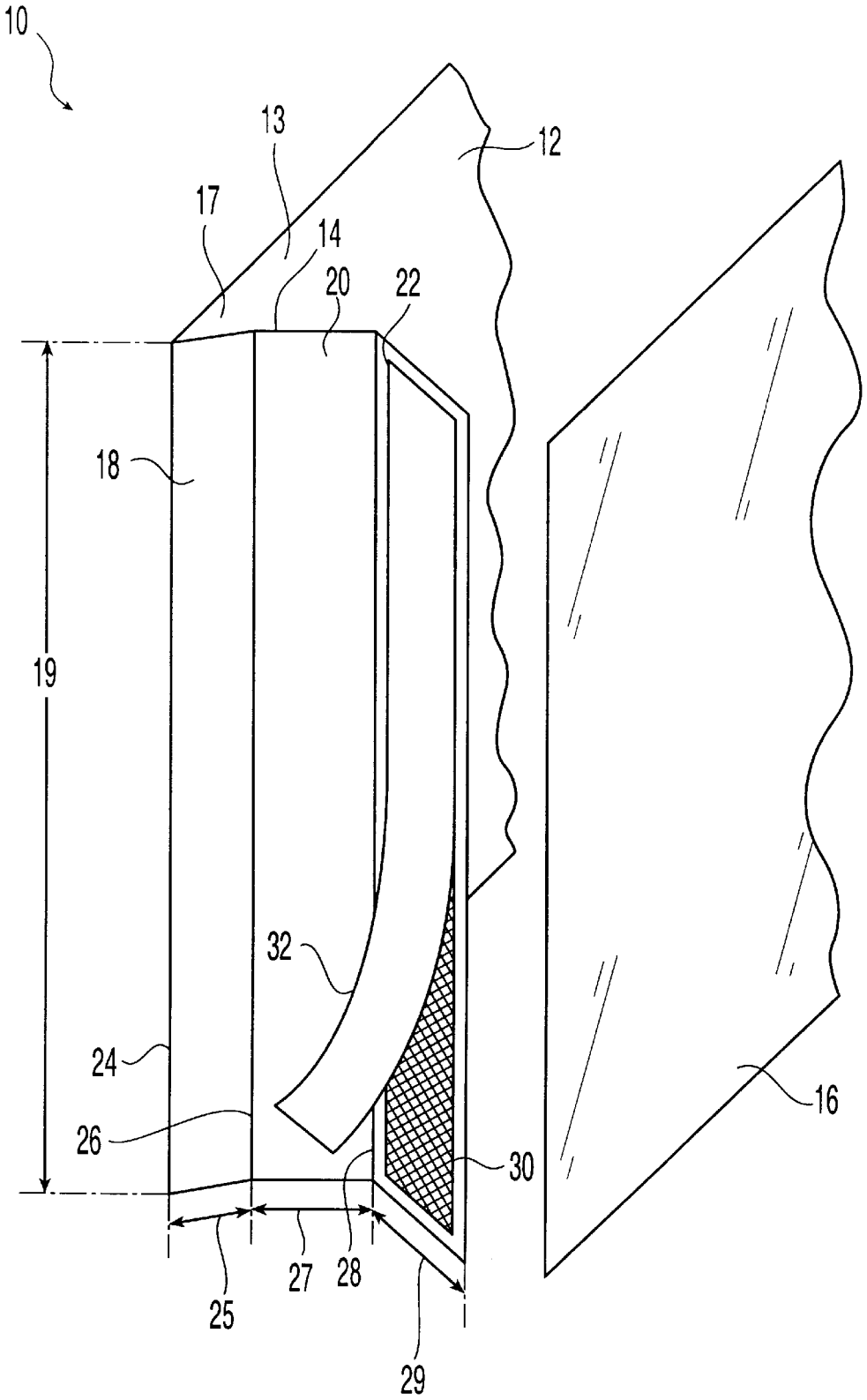
FIG. 1 is a partial perspective view of an embodiment of the sheet holder constructed according to the present invention.

Referring to FIG. 1, a preferred embodiment of a sheet holder 10 such as a report cover or other folder is shown having a back cover 12, a spine 14 and a front cover 16. The back cover 12 can also be of a unitary construction with the spine 14, and can be a part of a single piece of material. In the preferred embodiment, the spine 14 has a first panel 17 that extends toward the back cover 12. Additionally, the spine 14 has a second panel 18, a third panel 20 and a fourth panel 22. The second panel 18 is hingedly connected to the back cover 12 along a first hinge or fold line 24, the third panel 20 is hingedly connected to the second panel 18 along a second hinge or fold line 26, and the fourth panel 22 is hingedly connected to the third panel 20 along a third hinge or fold line 28. The fold lines 24, 26 and 28 are preferably substantially parallel to each other. The fold lines 24, 26 and 28 are preferably score lines or living hinges. Alternatively, the fold lines 24, 26 and 28 may be other types of hinges including perforated or weakened lines or pinned hinges. The back cover 12 may be an extension of a first panel 17 of the spine 14, and likewise, the front cover 16 may be an extension part of a second panel 18 of the spine 14.

The spine 14 is preferably integrally constructed with the back cover 12 such that the spine 14 may form an intermediate portion of the back cover 12. Most preferably, the spine 14 and the back cover 12 are of uniform construction. The spine 14, however, may be separately attached to the back cover 12 using known securing mechanisms such as adhesives, mechanical fasteners, stitches, or tape. Fold lines 24, 26 and 28 are disposed along the spine 14 to facilitate folding of the various sections about the stack of sheets during assembly. When viewed from the side of the holder 10 with one of the covers 12 and 16 substantially abutting a flat surface, the fold lines 24, 26 and 28 allow the panels of the intermediate portion 14 to form angled sides in the margin area when the sections are folded along the fold lines with the acuteness of the angle vary with the force applied resulting in generally tapered or rounded folds that bends about a point.

An adhesive material 30 is disposed on the outside surface of the fourth panel 22 of the spine 14 when the spine 14 is folded toward the back cover 12. The adhesive material 30 preferably covers most of the surface area of the fourth panel 22. A protective strip 32 is preferably secured to the adhesive material 30 and is removed to expose the adhesive material 30 during the assembly of the holder 10. Most preferably, the protective strip 32 completely covers the adhesive material 30 prior to the assembly of the sheet holder 10. The adhesive material 30 is preferably pressure sensitive, which allows the user to apply finger pressure along the outside surface of the spine 14 to secure the interfacing surfaces of the fourth panel 22 the back cover 12 of the sheet holder 10. Preferably the adhesive material 30 has quick and sufficient adhesion properties to provide flexibility and conformity to irregular surfaces. The protective strip 32 is coated with a non-stick surface and is secured to the adhesive material 30, preventing such material from exposure prior to the assembly of the sheet holder 10. Preferably the protective strip 32 has a dimension larger than the area of the fourth panel 22 coated with the adhesive material 30 to facilitate the removal of the protective strip 32. Most preferably, the protective strip 32 extends about ⅛th of an inch beyond each side of the adhesive material 30 on the fourth panel 22. Other types of adhesives may be used including glue, rubber cement, tape, etc.

Figure 2:
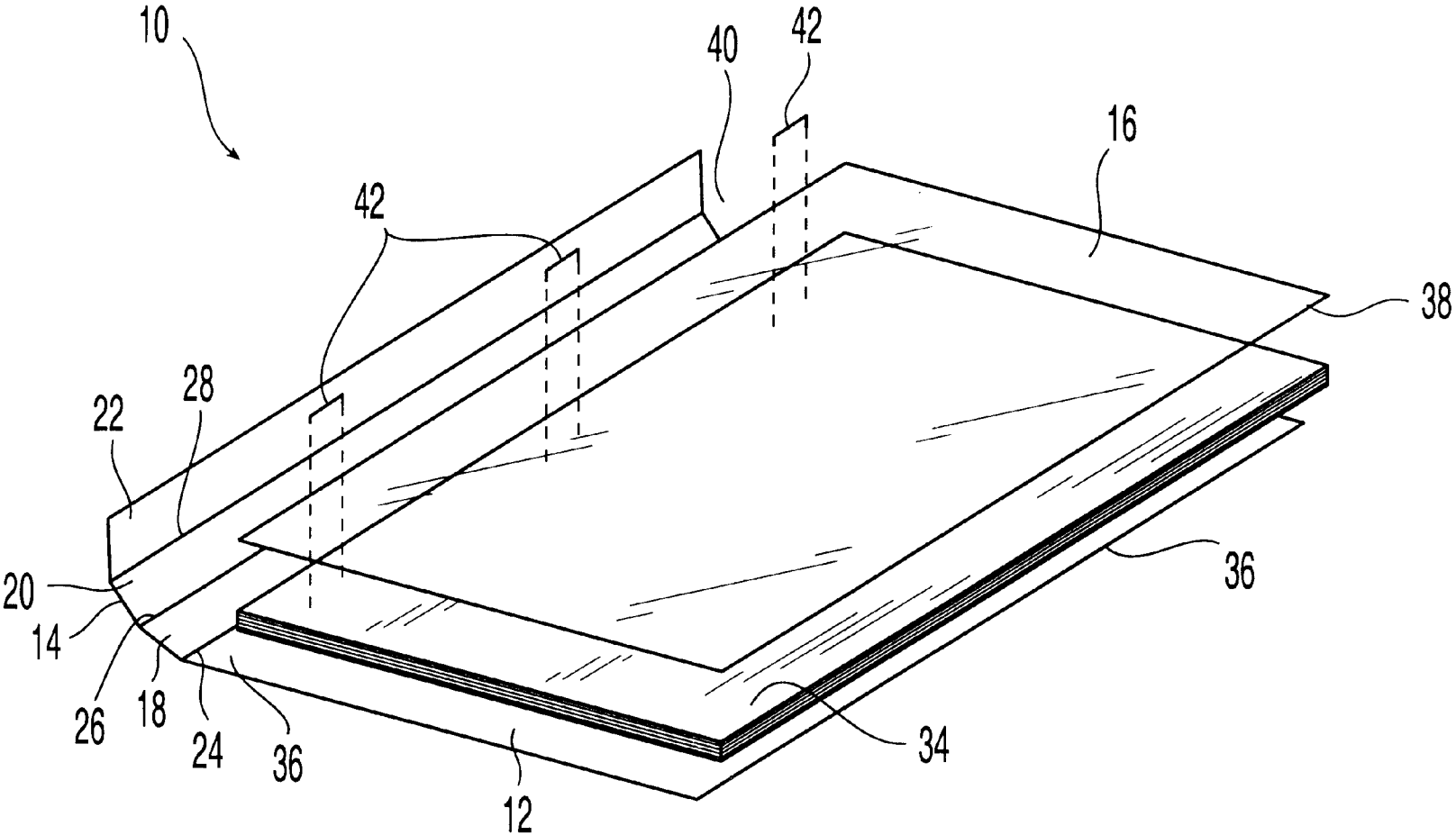
FIG. 2 is an exploded view of the sheet holder of FIG. 1 shown with a stack of sheets.

Referring now to FIG. 2, a stack of sheets 34 to be bound within the sheet holder 10 is shown placed over the back cover 12 proximate to the first fold line 24 and in substantial alignment with the outer edge 36 of the back cover 12. The front cover 16 is similarly placable over the stack 34 with its outer edge 38 in general alignment with the stack 34 and the inner edge 40 in substantial alignment with the first fold line 24. Although the preferred outer edge 38 is rounded, alterative edges having irregular shapes also suitable. The spine 14, with the sections 18, 20 and 22, is shown slightly folded along respective fold lines 24, 26 and 28. Mechanic fasteners 42 are positionable through the front cover 16, stack of sheets 34 and back cover 12. The dashed lines extending from the fasteners 42 toward the front cover 16 demonstrate the preferred path for securing these fasteners 42. Three mechanical fasteners 42 are preferred; other number of fasteners 42, however, are adaptable for use to secure the stack within the holder 10. While staples are shown as one embodiment of the mechanical fasteners 42, other fasteners known in the art may be utilized, including: wires; individual button-headed, pronged fastener; elongated pronged metal or plastic fasteners having strips through which the prongs of the fasteners extend when folded toward each other; rivets; and clamps. Preferably the attachment used does not protrude beyond the outer surface of the fourth panel 22 when the fourth panel 22 is attached to the first panel 17.

The sheet holder 10 of the present invention may be constructed of a number of materials to protect the contents therein. In view of providing ease of manufacturing and minimizing costs while achieving greater flexibility of usage, the back cover 12 and spine 14 are preferably fabricated from a single sheet of material constructed of typical stiff paper, card board, bristol board or plastic. The stiff paper or card board may be opaque, plastic coated or textured. The front cover 16 may be composed of the same stock as the back cover 12 and spine 14, however, the front cover 16 is most preferably formed of a transparent plastic sheet providing protection while displaying the stack of sheets 34 contained in the holder 10 and preferably as a separate sheet from the back cover 12.

The sheet holder 10 is preferably dimensioned to accommodate conventionally sized sheets of papers with sufficient clearance to fully protect the sheets held therein from external elements. An example of such sheets of paper is the standard 8½×11 inch sheets of paper commonly used in the U.S. or A4 or legal size. To accommodate this 8½×11 paper size, the preferred size of the back cover 12 is about 9×11.25 inches. In addition to accommodating the size of the sheets contained in the sheet holder 10, the dimension of the spine 14 is selected to accommodate the varying thicknesses of the stack of sheets 34 that may be held within the holder 10.

The fasteners 42, spine 14, with its three sections 18, 20 and 22, defines the binding mechanism of the holder 10 for securing the contents. The second panel 18 is preferably dimensioned to extend beyond the stack of sheets 34 and the front cover 16 by a lateral width 25 with sufficient lateral spatial distance remaining for securing the fasteners 42 through the holder 10. By increasing the width 25 of the second panel 18, the sheet holder 10 can hold more sheets. The preferred lateral width 25 of the second panel 18 is between about 0.4 inches to 1 inch, more preferably between about 0.5 inches to 0.7 inches. The preferred height 19 is about 11.25 inches. Preferably the third panel 20 is wider than the second panel 18, allowing the third panel 20 to completely cover the second panel 18 when it is folded over abutting the second panel 20. Preferably the fourth panel 22 is wider than the third panel 20. The third and fourth panels 20 and 22 are preferably dimensioned to sufficiently extend beyond the margin area where the fasteners 42 are secured to cover both the top and bottom parts of the fasteners 42. The preferred width of the third panel 20 is between about 0.7 inches to 0.8 inches, and the preferred width of the fourth panel 22 is between about 0.9 inches to 1 inch.

The front cover 16 is dimensioned to sufficiently cover the stack of sheets 34 and to provide sufficient area for securing the fasteners 42. The spine 14 can be provided in a variety of widths to accommodate the same back cover 12 according to the need of the user. Finally, for the above stated preferred dimensions of back cover and spine, the preferred dimension of the front cover is about 9×11.25 inches, and is preferably slightly larger than the dimension of the stack 34 contained therein.

Figure 3:
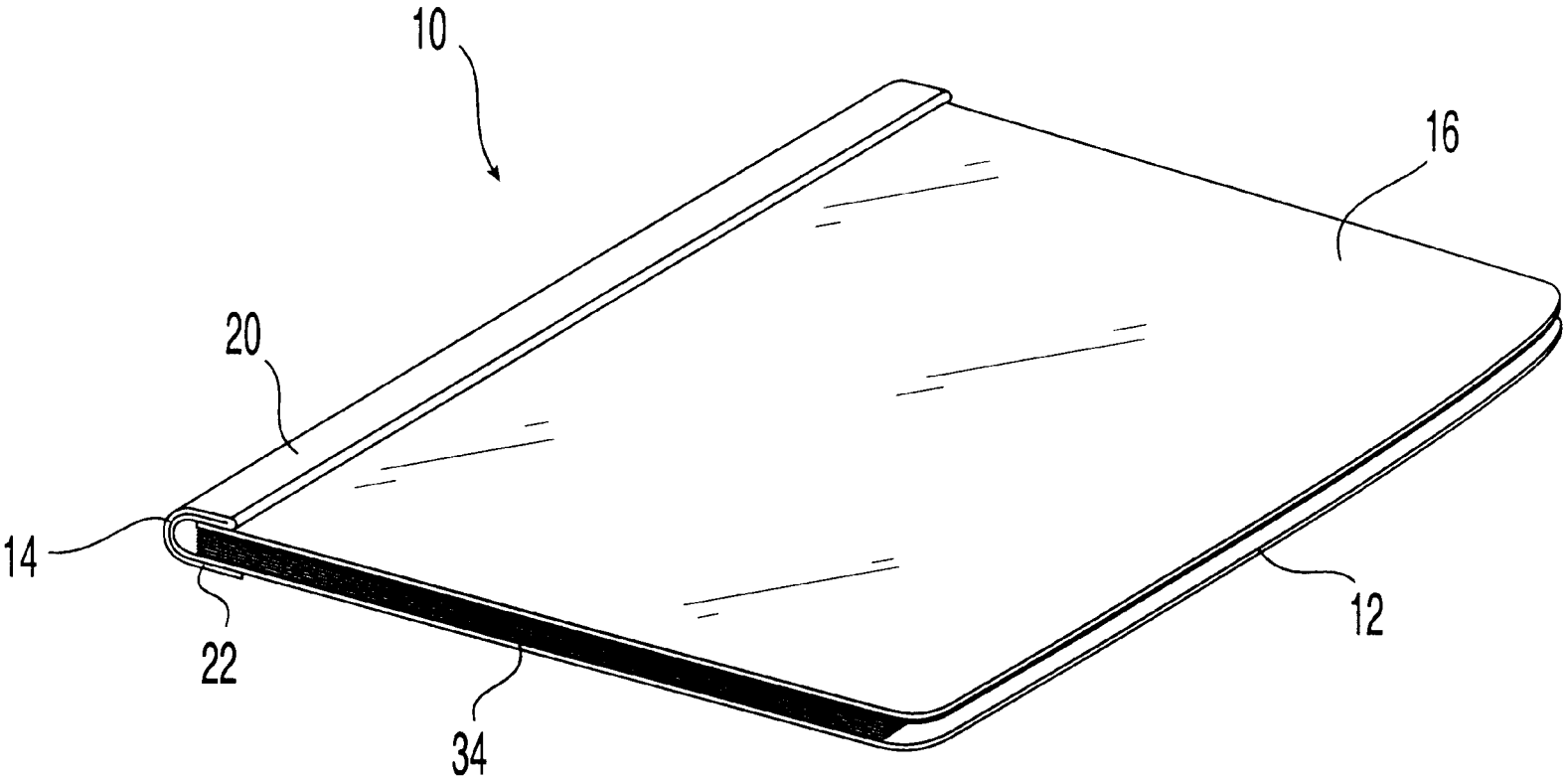
FIG. 3 is a perspective view of the sheet holder of FIG. 2 in an assembled configuration.

The sides of the front and back covers laterally opposed to the binding area may be curved and have rounded corners. A completely assembled sheet holder 10 of the preferred embodiment according to the present invention is shown in FIG. 3. The sheet holder 10 is shown having slightly curved outer edges to the front and back covers 12 and 16 with rounded corners. The covers 12 and 16 extend beyond the stack of sheets 34 to protect the sheets. The spine 14 is shown folded substantially along fold lines 24, 26 and 28 is a slightly curved fashion. The fasteners 42 are completely covered by the spine 14 from view and are prevented from damaging desk tops, injuring users, or catching objects adjacent to the fasteners, such as by catching with the staple legs.

Figure 4:
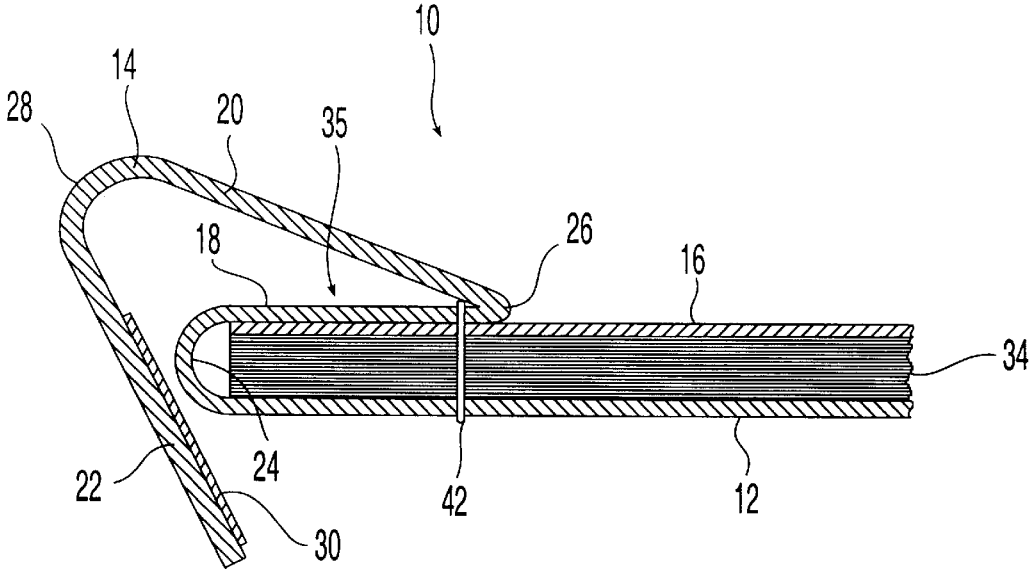
FIGS. 4 and 5 are partial, cross-sectional side views of the sheet holder showing the steps of assembly.
Figure 5:
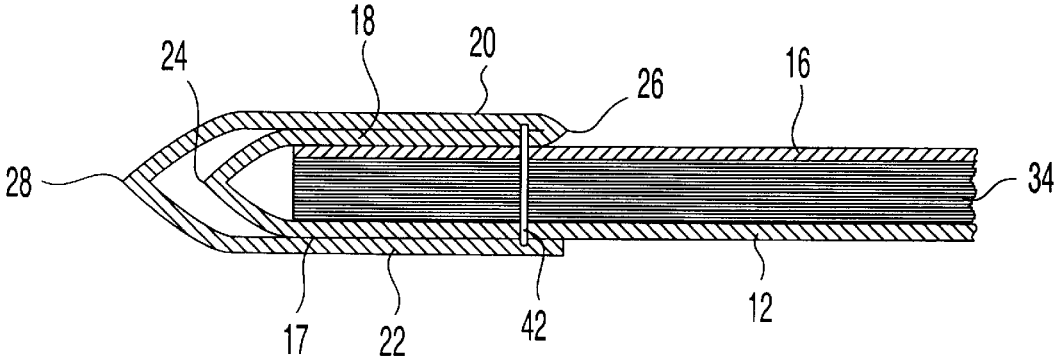

The assembly of the sheet holder 10 is shown with reference to FIGS. 2, 4 and 5. The stack of sheets 34 to be bound within the sheet holder 10 is placed over the back cover 12 proximate to the first fold line 24 and preferably in substantial alignment therewith. The front cover 16 is similarly placed over the stack 34 with its inner edge 40 in substantial alignment with the stack 34 and the first fold line 24.

Referring now to FIG. 4, the spine 14 is folded about the stack 34 and front cover 16, such that the second panel 18 is folded over the stack 34 and rests atop the front cover 16, abutting the outer surface thereof and forming an inner spine portion 35. Staples 42 are driven through the second panel 18 between the first fold line 24 and the second fold line 26. Preferably, the staples 42 are disposed closer to the second fold line, away from the edge of the stack 34 proximate to the folded portion of the second panel 18. Other positions, however, are also suitable. Preferably, staples 42 are pushed through the second panel 18, the front cover 16, the stack 34 and the back cover 12 proximate to the first fold line. Thus, the ends of the fasteners 42 protrude from the second panel 18 and the spine portion of the back cover 12. When the fastener 42 is a staple, the crown of the staple is against one sections of the spine 14, preferably the third panel 20. Spine portion of the back cover 12 and the legs of the staple fastener 42 are clinched against each other. The staples 42 may also be secured to the holder 10 by driving through the opposite side. Once the stack 34 is secured to the sheet holder 10, the spine 14 is further folded along fold line 26 back about the first or inner spine portion 18 toward the first fold line 24 such that the third panel 20 is placed atop and abuts the second panel 18 covering the top portions of the staples 42. The protective strip 32 may be removed at any time prior to this point of assembly to expose the adhesive material 30 disposed on the fourth panel 22. Referring now to FIG. 5, the spine 14 is then folded along fold line 28 such that the fourth panel 22 abuts and is secured to the back cover 12 via the adhesive material 30 covering the folded portions of the staples 42. Although the adhesives 30 is shown against the fasteners 42, the adhesives 30 may alternatively be disposed beyond the fastener 42, toward the first fold line 24 or free edges of the covers 12 and 16. As seen from FIGS. 2 and 5, the portions of the fastener 42 that remain be first and forth panels 17 and 22 and between the second and third panels 18 and 20 of this embodiment are substantially parallel with the panels 17, 18, 20, and 22.

Scorelines are preferably formed along the fold lines 24, 26 and 28 to facilitate assembly by making the spine more adaptable to folding along the fold lines 24, 26 and 28. The scorelines respond to pressure applied to the fold lines and from clean straight edges along the spine area of the sheet holder 4. The effect of the scorelines are best shown in FIG. 5. Additional score lines to accommodate various heights of the stacks 34 are also suitable. The fold lines 24, 26 and 28 formed as scorelines allow greater ease in folding the spine 14 during assembly. The scorelines tend to bend the spine 14 in pre-determined direction accordingly to the placement of the scorelines.

One of ordinary skill in the art can envision numerous variations and modifications to the invention disclosed herein. For example, the adhesive strip of the fourth panel of the spine may be applied separately by the user at the time of assembly, eliminating the need of a protective cover, or the spine may be constructed as a separate sheet form the back cover and attachable thereto. All of these modifications are contemplated by the true spirit and scope of the following claims.

What is claimed is:

1. A sheet holder comprising:

a) a spine including at least first, second, third, and fourth panels, wherein the first panel is attached to the second panel by a first hinge, the second panel is attached to the third panel by a second hinge, and the third panel is attached to the fourth panel by a third hinge such that the panels are attached in series, the panels and hinges being configured and associated such that the spine has a folded position in which:

i) the first and second panels are opposed to each other and define a first space therebetween dimensioned to receive a stack, ii) the third panel is folded over the second panel, and iii) the fourth panel is folded over the first panel, wherein the panels are associated in the folded position such that a binding fastener is positionable in a position to extend sequentially through the first panel, the stack in the first space, and the second panel, with fastener portions of the binding fastener disposed between the second and third panels and between the first and fourth panels such that the third and fourth panels cover the fastener portions; and b) a spine closure fastener associated with the first and fourth panels in the folded position.

2. The sheet holder of claim 1, wherein the spine closure fastener is disposed sufficiently near the third hinge to restrict rotation of the first and second panels relative to the third and fourth panels.

3. The sheet holder of claim 2, further comprising a back cover extending from the first panel to cover the stack.

4. The sheet holder of claim 3, wherein the back cover and the spine are integrally constructed.

5. The sheet holder of claim 3, further comprising a front cover which is disposed between the second panel and the stack when the spine is in the folded position.

6. The sheet holder of claim 5, wherein the first, second, third, and fourth panels and the back cover define a combined lateral width and the front cover defines a front lateral width such that the combined lateral width is greater than the front cover width.

7. The sheet holder of claim 1, wherein the binding fastener is a staple.

8. The sheet holder of claim 1, wherein spine closure fastener comprises an adhesive.

9. The sheet holder of claim 8, wherein the adhesive of the spine closure fastener further comprises an adhesive cover strip.

10. The sheet holder of claim 9, wherein the adhesive is disposed on the fourth panel and overlaps with the second panel.

11. The sheet holder of claim 1, wherein the third panel is wider than the second panel.

12. The sheet holder of claim 11, wherein the fourth panel is wider than the third panel.

13. The sheet holder of claim 1, wherein the first, second and third hinges are fold lines.

14. A sheet holder comprising:

a) a spine including at least first, second, third, and fourth panels in a folded position wherein the first panel is attached to the second panel by a first hinge, the second panel is attached to the third panel by a second hinge, and the third panel is attached to the fourth panel by a third hinge, such that the panels are attached in series, wherein:

i) the first and second panels are opposed to each other and define a first space therebetween dimensioned to receive a stack, ii) the third panel is folded over the second panel, and iii) the fourth panel is folded over the first panel, b) at least one binding fastener extending sequentially through the first panel, the stack in the first space, and the second panel, with fastener portions of the binding fastener disposed between the second and third panels and between the first and fourth panels such that the third and fourth panels cover the fastener portions; and c) a spine closure fastener disposed on the fourth panel for securing the fourth panel to the first panel and covering the binding fasteners.

15. The sheet holder of claim 14, wherein the spine closure fastener is disposed on the fourth panel proximate to the first hinge.

16. A method of holding at least one sheet in a sheet holder comprising:

inserting the at least one sheet between first and second panels of a spine that are hinged to each other to provide an inner spine portion;

securing the inner spine portion by driving a binding fastener therethrough; and fixing at least a third panel about the inner spine portion to cover the binding fastener adjacent both the first and second panels, wherein the fixing of the at least a third panel comprises folding a third panel of the spine over the second panel and a fourth panel of the spine over the first panel and securing the third and fourth panels to the sheet holder and the folding over of the third and fourth panels of the sheet holder comprises exposing adhesive material disposed on the fourth panel.

17. The method of claim 16, wherein the binding fastener comprises a staple.

18. The sheet holder of claim 5, wherein the front cover is of discontinuous with the panels.

19. The sheet holder of claim 14, further comprising the stack.

20. The sheet holder of claim 14, wherein the fastener portions comprise end portions of the binding fastener.

21. The sheet holder of claim 14, wherein in the folded position, the fastener portions are disposed between the second and third panels and between the first and fourth panels substantially parallel to the panels.

* * * * *